US010806182B2

(12) United States Patent
Qiu

(10) Patent No.: US 10,806,182 B2
(45) Date of Patent: Oct. 20, 2020

(54) ATOMIZER AND ELECTRONIC CIGARETTE THEREOF

(71) Applicant: CHANGZHOU JWEI INTELLIGENT TECHNOLOGY CO., LTD., Changzhou, Jiangsu (CN)

(72) Inventor: Weihua Qiu, Jiangsu (CN)

(73) Assignee: CHANGZHOU JWEI INTELLIGENT TECHNOLOGY CO., LTD., Changzhou, Jiangsu (CN)

( * ) Notice: Subject to any disclaimer, the term of this patent is extended or adjusted under 35 U.S.C. 154(b) by 336 days.

(21) Appl. No.: 15/857,380

(22) Filed: Dec. 28, 2017

(65) Prior Publication Data

US 2018/0116295 A1 May 3, 2018

Related U.S. Application Data

(63) Continuation of application No. PCT/CN2016/086297, filed on Jun. 17, 2016.

(30) Foreign Application Priority Data

Jul. 14, 2015 (CN) ..... 2015 2 0506388 U

(51) Int. Cl.
*A24F 40/49* (2020.01)
*A24F 47/00* (2020.01)
*B65D 50/06* (2006.01)

(52) U.S. Cl.
CPC ..... *A24F 47/008* (2013.01); *A24F 40/49* (2020.01); *A24F 47/00* (2013.01); *B65D 50/062* (2013.01)

(58) Field of Classification Search
CPC ..... A24F 47/00; A24F 47/008
USPC ..... 131/328
See application file for complete search history.

(56) References Cited

U.S. PATENT DOCUMENTS 4,184,496 A 1/1980 Adair
2015/0296889 A1* 10/2015 Liu ..... A24F 47/008 131/329
2015/0342257 A1* 12/2015 Chen ..... H05B 3/06 392/390
2018/0035718 A1* 2/2018 Liu ..... A24F 47/00

FOREIGN PATENT DOCUMENTS

CN 104106843 A 10/2014
CN 204217910 U 3/2015

* cited by examiner

*Primary Examiner* — Michael J Felton
(74) *Attorney, Agent, or Firm* — Novick, Kim & Lee, PLLC; Allen Xue

(57) ABSTRACT

An atomizer for an electronic cigarette has a liquid storage assembly, a bottom connecting assembly and a base assembly. The bottom connecting assembly includes a base threaded ring. The base assembly comprises a lower cover fitted with the base threaded ring and an adjustment ring rotatably sleeved about the lower cover. The adjustment ring has a latch while the lower cover provides a corresponding latching slot. The base threaded ring and the base assembly can be disassembled or assembled by adjusting the relative positions of the latch and the latching slot. The atomizer has a novel structure, good usability, and is child-proof.

18 Claims, 6 Drawing Sheets

ATOMIZER AND ELECTRONIC CIGARETTE THEREOF

CROSS-REFERENCE TO RELATED APPLICATIONS

This application is a continuation application of International Patent Application No. PCT/CN2016/086297, filed on Jun. 17, 2016, which claims priority to Chinese Patent Application No. CN201520506388.2, filed on Jul. 14, 2015.

FIELD

The subject matter herein generally relates to electronic cigarette technology, and more particularly, to an atomizer and an electronic cigarette with the atomizer.

BACKGROUND

A conventional electronic cigarette includes a cigarette holder, an atomizer and a battery for powering to the atomizer. The existing atomizer of the electronic cigarette comprises a housing, an atomizer head and a cartridge or liquid chamber for storing smoke liquid, and the atomizer head and the cartridge or liquid chamber are mounted in the housing. In order to facilitate the replacement of the cartridge or addition of smoke liquid, the existing electronic cigarette uses threaded connections, clamping connections or magnetic connections, etc. Thus the structure of the electronic cigarette is simple and easy to be opened. However, in absence of any complex structure, the electronic cigarette can be easily opened by children. As a result, the cartridge or liquid chamber will be exposed and children may be exposed to cigarette liquid.

SUMMARY

In view of the deficiencies in the prior art, the present disclosure provides an atomizer having a novel structure, good usability, and a child-proof function which prevents kids from opening the atomizer. The present disclosure also provides an electronic cigarette with the atomizer. In order to achieve the purpose mentioned above, the present disclosure is realized by the following technical solutions.

An atomizer comprises a liquid storage assembly, a bottom connecting assembly and a base assembly. The bottom connecting assembly includes a base threaded ring, and the base assembly is detachably connected to the liquid storage assembly through the base threaded ring. The base assembly comprises a lower cover fitted with the base threaded ring and an adjustment ring rotatably sleeved about the lower cover. The adjustment ring defines a latch, and the lower cover defines a corresponding latching slot. The base threaded ring and the base assembly can be disassembled or assembled by adjusting the relative positions of the latch and the latching slot.

Further, the adjustment ring is freely rotatable around the lower cover before the latch is engaged with the latching slot.

Further, when the latch is engaged with the latching slot, the rotation of the adjustment ring drives the base threaded ring to rotate.

Further, the lower cover comprises a latching slot indicating mark, and the adjustment ring comprises an adjustment gap indicating mark and a latch indicating mark.

Further, the latching slot is aligned with the latch by adjusting the latching slot indicating mark to align with the latch indicating mark.

Further, when the latching slot is aligned with the latch, the latch is engaged with the latching slot by sliding the adjustment ring downwardly.

Further, the atomizer further comprises an atomizer head assembly arranged on the bottom connecting assembly. The atomizer head assembly is threadedly connected with the base threaded ring, and the base threaded ring is connected with the lower cover by an interference fit.

Further, the atomizer further comprises a gasket arranged in the base assembly, a positive electrode contact arranged at a bottom of the base assembly, and an insulating ring sleeved on the positive electrode contact.

Further, the bottom connecting assembly further comprises a base connection threadedly connected to the base threaded ring.

An electronic cigarette comprises an atomizer according to any one hereinabove.

An atomizer comprises a liquid storage assembly and a base assembly. The base assembly comprises a lower cover detachably connected to the liquid storage assembly and an adjustment ring rotatably sleeved about the lower cover. The adjustment ring defines a latch, and the lower cover defines with a corresponding latching slot. Alternatively, the adjustment ring defines a latching slot, and the lower cover defines a corresponding latch. The liquid storage assembly and the base assembly can be disassembled or assembled by adjusting the relative positions of the latch and the latching slot.

Further, the adjustment ring is freely rotatable around the lower cover before the latch is engaged with the latching slot.

Further, when the latch is engaged with the latching slot, the rotation of the adjustment ring drives the base threaded ring to rotate.

Further, the lower cover comprises a latching slot indicating mark, and the adjustment ring comprises an adjustment gap indicating mark and a latch indicating mark. Alternatively, the lower cover comprises a latch indicating mark, and the adjustment ring comprises an adjustment gap indicating mark and a latching slot indicating mark.

Further, the latching slot is aligned with the latch by adjusting the latching slot indicating mark to align with the latch indicating mark.

Further, when the latching slot is aligned with the latch, the latch is engaged with the latching slot by sliding the adjustment ring downwardly.

Further, the atomizer further comprises a bottom connecting assembly. The bottom connecting assembly includes a base connection and a base threaded ring. The base connection is fixedly connected to the liquid storage assembly. The base threaded ring is fixedly connected with the lower cover and is detachably connected with the base connection.

Further, the base connection is integrally formed with the liquid storage assembly, and/or the base threaded ring is integrally formed with the lower cover.

Further, the atomizer further comprises an atomizer head assembly arranged on the bottom connecting assembly. The atomizer head assembly is threadedly connected with the base threaded ring, and the base threaded ring is connected with the lower cover by an interference fit.

An electronic cigarette comprises an atomizer according to any one hereinabove.

Compared with the prior art, the atomizer provided by the present disclosure at least has the following advantages. The adjustment ring of the atomizer is provided with a latch, and the lower cover is provided with a latching slot. Alternatively, the adjustment ring is provided with a latching slot, and the lower cover is provided with a latch. The latch indicating mark is rotated and adjusted to align with the latching slot indicating mark according to the adjustment gap indicating mark, so that the latch is aligned with the latching slot. Then the latch is completely engaged with the latching slot by sliding the adjustment ring downwardly. Due to the interaction of the latch and the latching slot, the rotation of the adjustment ring drives the lower cover to rotate. Meanwhile, the base threaded ring is connected to the lower cover by an interference fit and is connected to the base connection by a threaded connection. Therefore, the base threaded ring and the base assembly can be disassembled or assembled.

BRIEF DESCRIPTION OF THE DRAWINGS

Implementations of the present technology will now be described, by way of example only, with reference to the attached figures.

Figure 1:
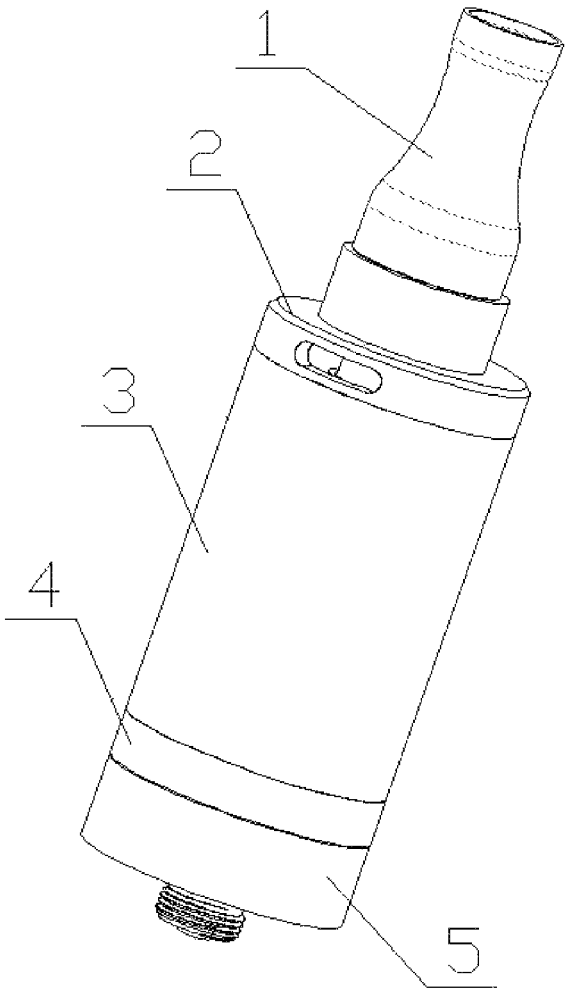
FIG. 1 is a perspective view of an atomizer according to one embodiment of the present disclosure.

The description of the reference number:

| | |
|---|---|
| Cigarette holder 1 | Upper cover connecting assembly 2 |
| Liquid storage assembly 3 | Bottom connecting assembly 4 |
| Base connection 41 | Base threaded ring 42 |
| Base assembly 5 | Lower cover 51 |
| Latching slot 511 | Latching slot indicating mark 512 |
| Adjustment ring 52 | Adjustment gap indicating mark 522 |
| Latch 523 | Latch indicating mark 524 |
| Gasket 6 | Insulating ring 7 |
| Positive electrode contact 8 | Atomizer head assembly 9 |

DETAILED DESCRIPTION

In order to make the above-mentioned objects, features and advantages of the present application more obvious, a detailed description of specific embodiments of the present application will be described in detail with reference to the accompanying drawings. A number of specific details are set forth in the following description so as to fully understand the present application. However, the present application can be implemented in many other ways different from those described herein, and those skilled in the art can make similar improvements without violating the contents of the present application. Therefore, the present application is not to be considered as limiting the scope of the embodiments described herein.

Figure 2:
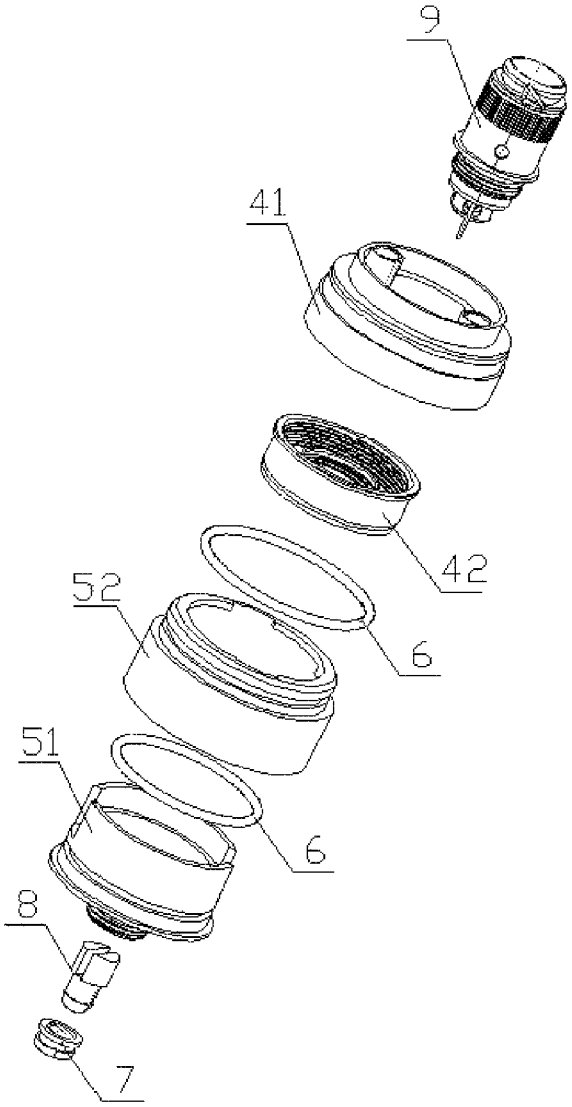
FIG. 2 is a partially exploded view of the atomizer shown in FIG. 1.
Figure 3:
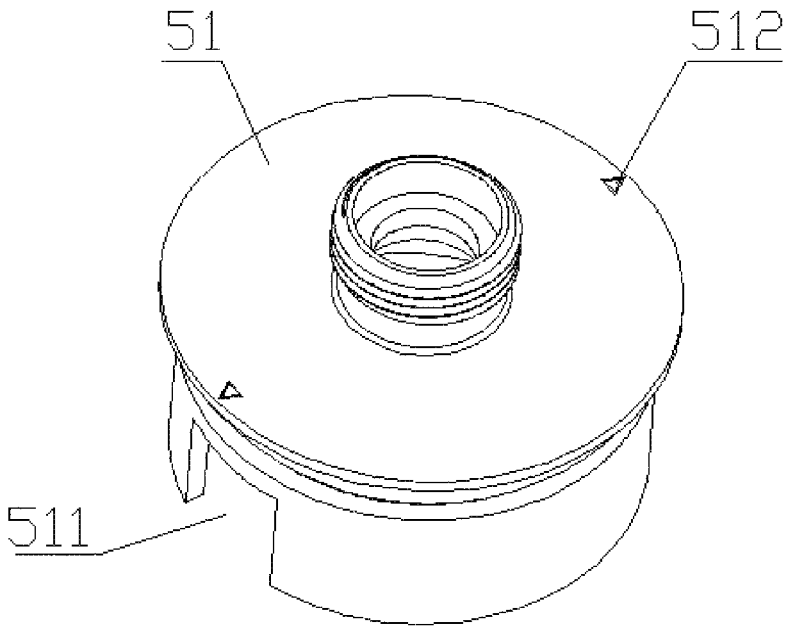
FIG. 3 is a perspective view of the lower cover shown in FIG. 2.
Figure 4:
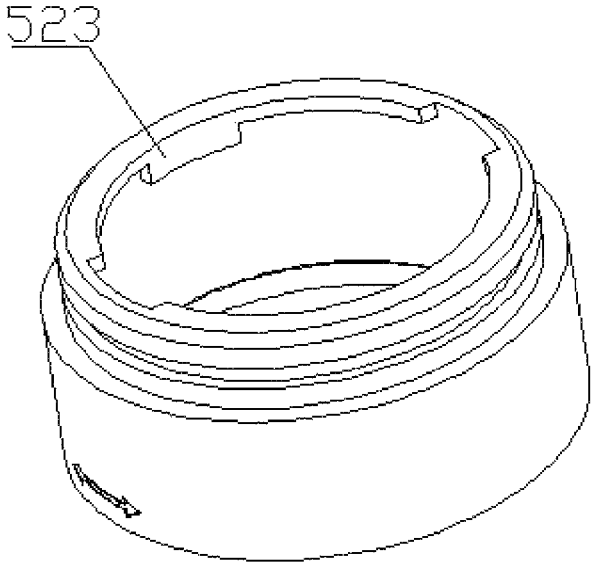
FIG. 4 is a perspective view of the adjustment ring shown in FIG. 2.
Figure 5:
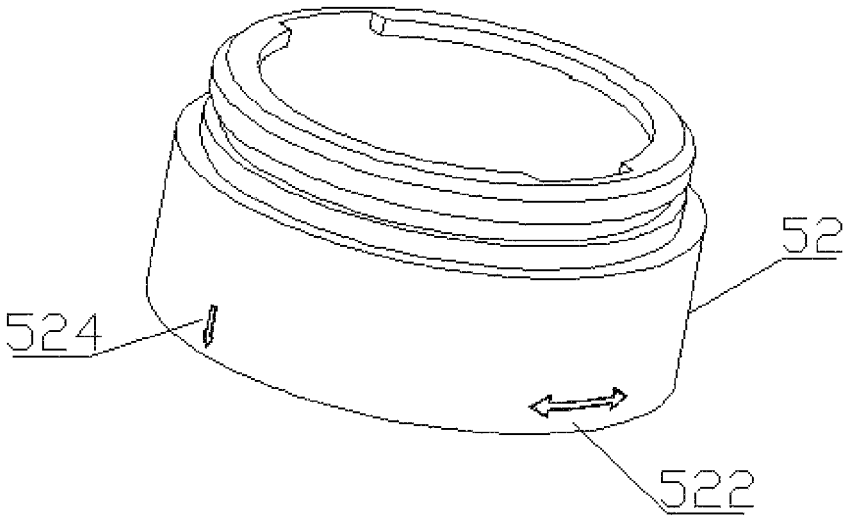
FIG. 5 is a perspective view showing another state of the adjustment ring shown in FIG. 2.
Figure 6:
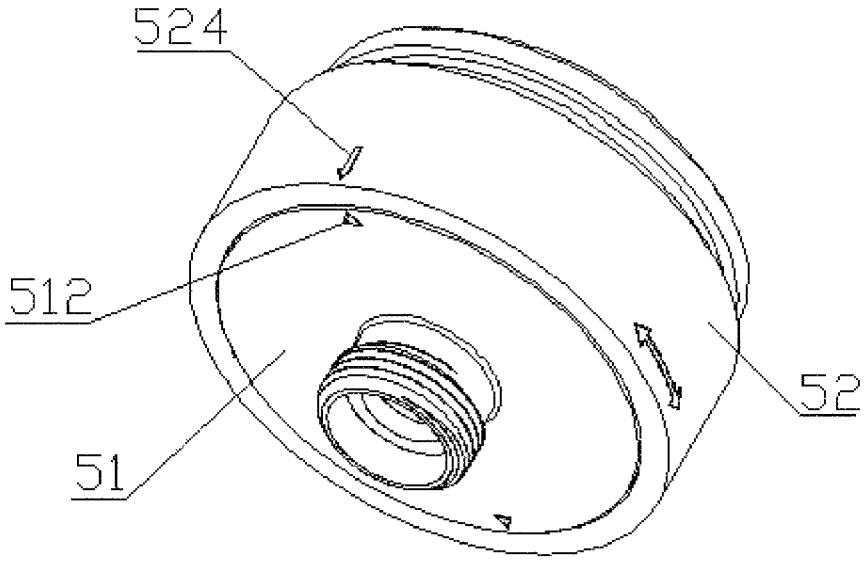
FIG. 6 is a perspective view of the lower cover aligned with the adjustment ring shown in FIG. 2.
Figure 7:
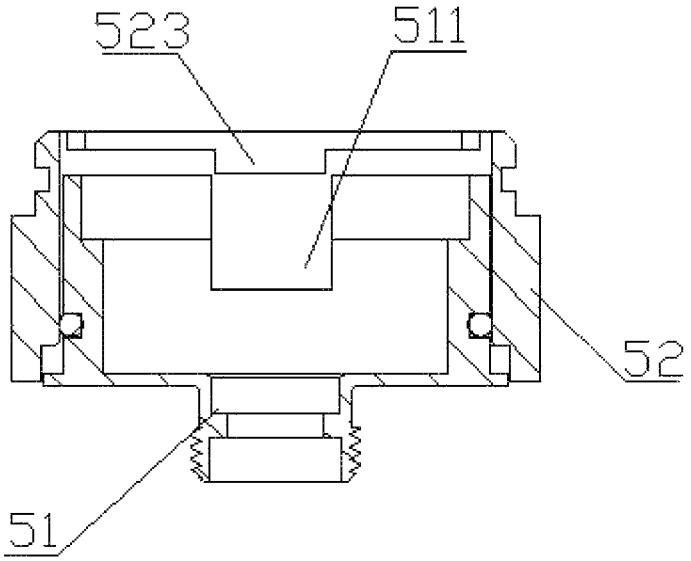
FIG. 7 is a cross-sectional view of the lower cover aligned with the adjustment ring shown in FIG. 2.
Figure 8:
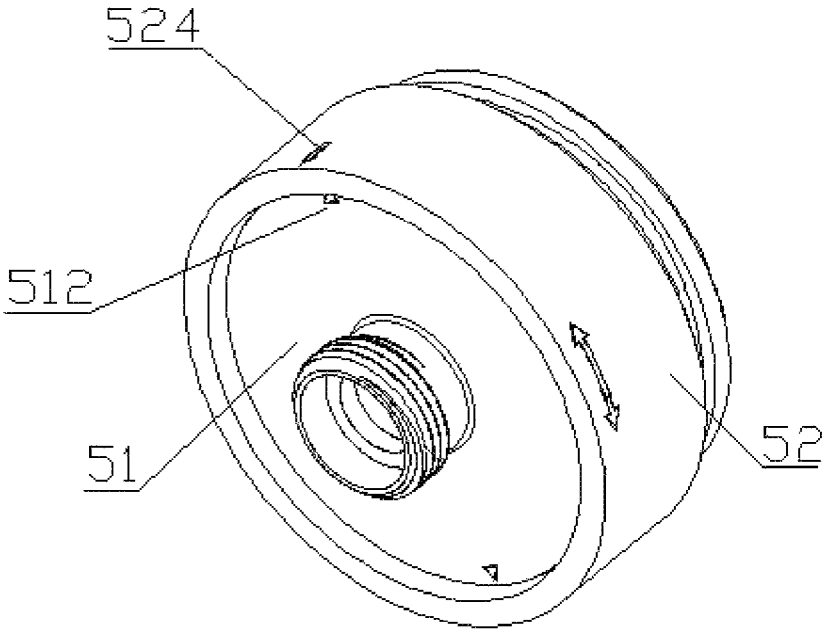
FIG. 8 is a perspective view showing the completion of assembling the lower cover and the adjustment ring shown in FIG. 2.
Figure 9:
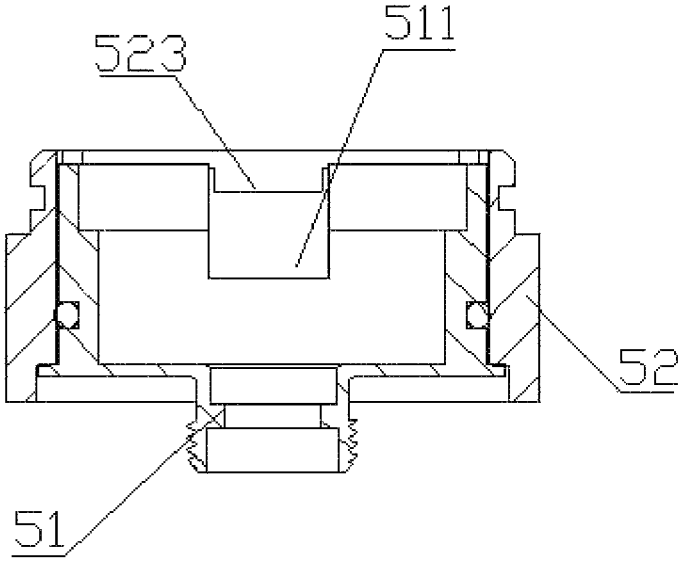
FIG. 9 is a cross-sectional view showing the completion of assembling the lower cover and the adjustment ring shown in FIG. 2.

As shown in FIG. 1 to FIG. 9, an atomizer is provided in the present disclosure. The atomizer includes a cigarette holder 1, an upper cover connecting assembly 2, a liquid storage assembly 3, a bottom connecting assembly 4 and a base assembly 5, which are successively connected from top to bottom. The atomizer further includes a gasket 6 located in the base assembly 5, a positive electrode contact 8 provided at a bottom of the base assembly 5, an insulating ring 7 sleeved on the positive electrode contact 8, and an atomizer head assembly 9 provided on the bottom connecting assembly 4. The bottom connecting assembly 4 includes a base connection 41 fixedly connected to the liquid storage assembly 3 and a base threaded ring 42 threadedly connected to the base connection 41. The base assembly 5 includes a lower cover 51 fitted with the base threaded ring 42 and an adjustment ring 52 rotatably sleeved about the lower cover 51. The adjustment ring 52 defines a latch 523, and the lower cover 51 defines a latching slot 511 configured to match the latch 523. The base threaded ring 42 and the base assembly 5 can be disassembled or assembled by adjusting the relative positions of the latch 523 and the latching slot 511. Before the latch 523 is engaged with the latching slot 511, the adjustment ring 52 is allowed to freely rotate around the lower cover 51. When the latch 523 and the latching slot 511 are completely engaged with each other, the adjustment ring 52 can be turned by user to drive the base threaded ring 42 to rotate. The lower cover 51 defines a latching slot indicating mark 512, and the adjustment ring 52 defines an adjustment gap indicating mark 522 and a latch indicating mark 524.

By adjusting the latching slot indicating mark 512 to align with the latch indicating mark 524, the latching slot 511 is aligned with the latch 523. And then, the latch 523 is completely engaged with the latching slot 511 by sliding the adjustment ring 52 downwardly. In the illustrated embodiment, the atomizer head assembly 9 is threadedly connected to the base threaded ring 42, and the base threaded ring 42 is connected with the lower cover 51 by an interference fit.

According to the atomizer of the present disclosure, the adjustment ring 52 is provided with a latch 523, and the lower cover 51 is provided with a latching slot 511. The latch indicating mark 524 is rotated and adjusted to align with the latching slot indicating mark 512 according to the adjustment gap indicating mark 522, thus the latch 523 is aligned with the latching slot 511. Then the latch 523 is completely engaged with the latching slot 511 by sliding the adjustment ring 52 downwardly. Due to the interaction of the latch 523 and the latching slot 511, the rotation of the adjustment ring 52 drives the lower cover 51 to rotate. Meanwhile, the base threaded ring 42 is connected to the lower cover 51 by an interference fit, so that the rotation of the lower cover 51 can further drive the base threaded ring 42 to rotate. The base threaded ring 42 is connected to the base connection 41 by a threaded connection, thus, through the rotation of the base threaded ring 42, the threaded connection between the base threaded ring 42 and the base connection 41 can be released. As a result, the base threaded ring 42 and the base assembly 5 can be disassembled from the liquid storage assembly 3, so as to replace the atomizer head assembly 9 and/or to add the cigarette liquid. On the contrary, the base threaded ring 42 and the base assembly 5 can be assembled. Children can only do some simple operation, so that they cannot identify the indicating mark and disassemble the base threaded ring 42 and the base assembly 5 through a series of actions including aligning, sliding downwardly and rotating. As a result, the purpose of preventing children from opening the atomizer can be achieved.

It can be appreciated that, in other embodiments, the base connection 41 can be integrally formed with the liquid storage assembly 3.

It can be appreciated that, in other embodiments, the base connection 41 can be detachably connected to the base threaded ring 42 by clamping.

It can be appreciated that, in other embodiments, the base threaded ring 42 can be integrally formed with the lower cover 51.

It can be appreciated that, in other embodiments, the latch 523 may be defined in the lower cover 51. Correspondingly, the latching slot 511 may be defined in the adjustment ring 52.

Further, the present disclosure also provides an electronic cigarette (not shown in figures) including the above atomizer.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An atomizer comprising:

a liquid storage assembly;

a bottom connecting assembly comprising a base connection fixedly connected to the liquid storage assembly and a base threaded ring threadedly connected to the base connection; and a base assembly comprising a lower cover connected with the base threaded ring, an adjustment ring rotatably sleeved about the lower cover, and an electrode contact arranged at a bottom of the base assembly and an insulating ring sleeved on the positive electrode contact, wherein the lower cover is fixedly connected to the based threaded ring, the adjustment ring comprises a latch and the lower cover comprises a latching slot so that the lower cover and the adjustment ring are connected by engaging the latch with the latching slot.

2. The atomizer according to claim 1, wherein the adjustment ring is rotatable around the lower cover when the latch is not engaged with the latching slot.

3. The atomizer according to claim 2, wherein the rotation of the adjustment ring drives the base threaded ring to rotate when the latch is engaged with the latching slot.

4. The atomizer according to claim 1, wherein the lower cover comprises a latching slot indicating mark, and the adjustment ring comprises an adjustment gap indicating mark and a latch indicating mark.

5. The atomizer according to claim 4, wherein the latching slot is aligned with the latch by adjusting the latching slot indicating mark to align with the latch indicating mark.

6. The atomizer according to claim 5, wherein when the latching slot is aligned with the latch, the latch is engaged with the latching slot by sliding the adjustment ring downwardly.

7. The atomizer according to claim 1, further comprising an atomizer head assembly arranged on the bottom connecting assembly, wherein the atomizer head assembly is threadedly connected with the base threaded ring, and the base threaded ring is connected with the lower cover by an interference fit.

8. The atomizer according to claim 1, wherein the base connection is integrally formed with the liquid storage assembly.

9. An atomizer comprising:

a liquid storage assembly; and a base assembly comprising a lower cover detachably connected to the liquid storage assembly, an adjustment ring rotatably sleeved about the lower cover, and an electrode contact arranged at a bottom of the base assembly and an insulating ring sleeved on the positive electrode contact, wherein one of the adjustment ring or the lower cover comprising a latch and the other comprises a latch slot configured to engage the latch, and wherein the liquid storage assembly and the base assembly are assembled by engaging the latch and the latch slot and are disassembled by disengaging the latch and the latch slot.

10. The atomizer according to claim 9, wherein the adjustment ring is rotatable around the lower cover when the latch is not engaged with the latching slot.

11. The atomizer according to claim 10, wherein the rotation of the adjustment ring drives the base threaded ring to rotate when the latch is engaged with the latching slot.

12. The atomizer according to claim 9, wherein one of the lower cover and the adjustment ring comprises a latching slot indicating mark, and the other comprises an adjustment gap indicating mark and a latch indicating mark.

13. The atomizer according to claim 12, wherein the latching slot is aligned with the latch by aligning the latching slot indicating mark with the latch indicating mark.

14. The atomizer according to claim 13, wherein when the latching slot is aligned with the latch, the latch is engaged with the latching slot by sliding the adjustment ring downwardly.

15. The atomizer according to claim 9, further comprising a bottom connecting assembly, wherein the bottom connecting assembly comprises a base connection and a base threaded ring, the base connection is fixedly connected to the liquid storage assembly, the base threaded ring is fixedly connected with the lower cover and is detachably connected with the base connection.

16. The atomizer according to claim 15, wherein the base connection is integrally formed with the liquid storage assembly, or the base threaded ring is integrally formed with the lower cover, or both.

17. The atomizer according to claim 15, further comprising an atomizer head assembly arranged on the bottom connecting assembly, wherein the atomizer head assembly is threadedly connected with the base threaded ring, and the base threaded ring is connected with the lower cover by an interference fit.

18. An electronic cigarette comprising the atomizer of claim 9.

* * * * *